United States Patent [19]

Banning

[11] 4,103,834

[45] Aug. 1, 1978

[54] APPARATUS FOR WINDING AN IMPROVED YARN SUPPLY PACKAGE

[75] Inventor: Jack A. Banning, Rocky Mount, N.C.

[73] Assignee: Phillips Fibers Corporation, Greenville, S.C.

[21] Appl. No.: 815,399

[22] Filed: Jul. 13, 1977

[51] Int. Cl.[2] ..... B65H 54/02; B65H 65/00

[52] U.S. Cl. ..... 242/18 PW; 242/18 DD; 242/165; 242/167

[58] Field of Search ..... 242/18 PW, 18 A, 18 R, 242/18 DD, 25 A, 43 R, 165, 167; 57/34 TT

[56] References Cited

U.S. PATENT DOCUMENTS

| | | | |
|---|---|---|---|
| 2,395,890 | 3/1946 | Lodge | 242/18 PW |
| 2,517,625 | 8/1950 | Bauer et al. | 242/18 PW |
| 3,075,715 | 1/1963 | Hensen et al. | 242/18 PW |
| 3,149,795 | 9/1964 | Rhein, Jr. | 242/18 A |
| 3,717,310 | 2/1973 | Ritter | 242/18 A |
| 3,819,123 | 6/1974 | Luz | 242/18 PW |
| 3,870,240 | 3/1975 | Miller | 242/18 A |
| 3,971,518 | 7/1976 | Newman et al. | 242/18 PW |
| 3,982,707 | 9/1976 | Saleeby | 242/18 PW |
| 3,999,716 | 12/1976 | Spaller, Jr. | 242/18 PW |
| 4,002,305 | 1/1977 | Takeuchi et al. | 242/18 PW |
| 4,002,307 | 1/1977 | Turk et al. | 242/18 A |

FOREIGN PATENT DOCUMENTS

| | | | |
|---|---|---|---|
| 704,376 | 2/1954 | United Kingdom | 242/18 PW |

*Primary Examiner*—Stanley N. Gilreath

[57] ABSTRACT

An improved yarn supply package comprising a yarn package holder is provided with a first yarn waste bunch wound on the package holder at one end portion thereof and a second yarn waste bunch connected to the first waste bunch and wound on the package holder intermediate the first waste bunch and the opposite end portion of the package holder. A main yarn package is wound on the package holder a distance from the second yarn waste bunch and is connected thereto by a yarn transfer tail. A power cylinder-actuated yarn tailing mechanism and a control system for the automatic control of the operation of the tailing mechanism is disclosed wherein the rod end of the cylinder carries a first tailing pin for guiding the initial windings of yarn on the package holder to form the first yarn waste bunch. A second tailing pin is carried by a tailing pin head and is supported adjacent the piston rod so that it moves along a line parallel to the axis of the piston rod. The second tailing pin guides the yarn to form the second yarn waste bunch and the yarn transfer tail. A mechanism interconnects the piston rod and the tailing pin head to move the second tailing pin along its guiding path.

10 Claims, 8 Drawing Figures

APPARATUS FOR WINDING AN IMPROVED YARN SUPPLY PACKAGE

The present invention relates generally to the winding of yarn supply packages.

When producing melt spun yarns such as polyester, nylon, polypropylene or other fibers, it is necessary to produce transfer tails at the beginning of each supply package winding to facilitate the future use of the yarn. The conventional method of transfer tail formation requires that the tail be dressed, that is, cleaned up with the end of the tail taped to the package. This is a time consuming process, and in its performance there is the chance of damaging the yarn, for example, placing the tape across more than one wrap of the transfer tail. Also, the tail is allowed to become slack during the cleanup operation, and this can allow the tail to lose coherency which can alter the physical characteristics of the yarn resulting in undesirable characteristics in the yarn such as inconsistent die absorption capability and inconsistent results during texturing processing.

It is simple and well known to produce a plurality of yarn wraps one on top of the other, commonly referred to as a yarn waste bunch, on the conventional plastic start-up insert in the outer end of a package holder bobbin. This yarn waste bunch serves to secure the otherwise free end of the transfer tail during winding. However, if the single waste bunch is formed on the start-up insert, the transfer tail must run across the area of contact between the starting land of the drive roll of the winding machine and the bobbin, thus resulting in cutting of the transfer tail through friction between the drive roll and the package. This then results in the transfer tail becoming loose and the transfer tail may then be destroyed during the remainder of the winding process.

One object of the present invention is to provide an improved yarn supply package.

Another object of the present invention is to provide a new method for producing a yarn supply package.

A further object of the present invention is to provide new apparatus for winding an improved yarn supply package.

These and other objects, advantages, details and embodiments of the present invention will become apparent to one skilled in the art from the following detailed description and accompanying drawings of the invention together with the appended claims.

In accordance with the present invention I have discovered that an improved yarn supply package comprising two waste bunches of yarn on the bobbin can be automatically and efficiently produced through the employment of a pneumatically controlled yarn tailing apparatus in conjunction with a yarn winding machine.

More specifically, in the present invention there is provided a pneumatically controlled yarn tailing apparatus in which a two-way pneumatic cylinder carries a first tailing pin on the piston rod thereof for guiding a running yarn after its initial engagement on the rotating yarn package holder to form a first yarn waste bunch on the first end portion of the yarn package holder. Upon formation of the first yarn waste bunch, the control system is actuated to cause the pneumatic cylinder to retract thus guiding the running yarn from the first yarn waste bunch along the yarn package holder into contact with the temporarily stationary second tailing pin. The second tailing pin guides the running yarn into position to form the second waste bunch while the pneumatic cylinder continues to retract the first tailing pin out of position for contact with the running yarn. After a predetermined amount of retraction of the piston rod, the second tailing pin is engaged by the piston rod through a linking mechanism and is retracted therewith to guide the running yarn along the yarn package holder to form a transfer tail thereon. The traversing mechanism of the yarn winding machine then engages the running yarn as the second tailing pin is withdrawn from contact therewith and the main yarn package is then wound on the yarn package holder in a conventional manner.

The present invention is illustrated in the accompanying drawings in which.

Figure 4:
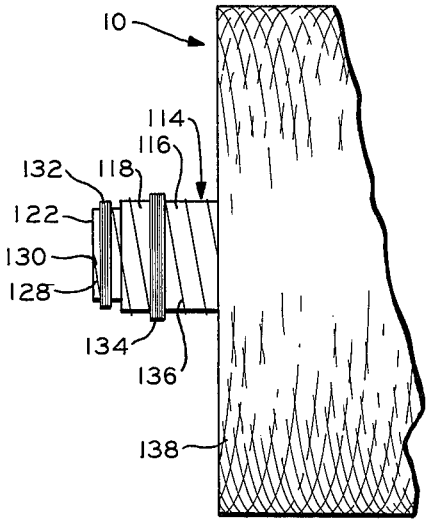
FIG. 4 is an enlarged, partial elevation view of one end of a yarn supply package constructed in accordance with the present invention and illustrating the positions of the yarn waste bunches and transfer tail thereof.

Referring now to the drawings, the improved yarn supply package of the present invention is generally designated by the reference character 10. The yarn supply package 10 is formed on an improved yarn winder which is generally designated by the reference character 12.

Figure 1:
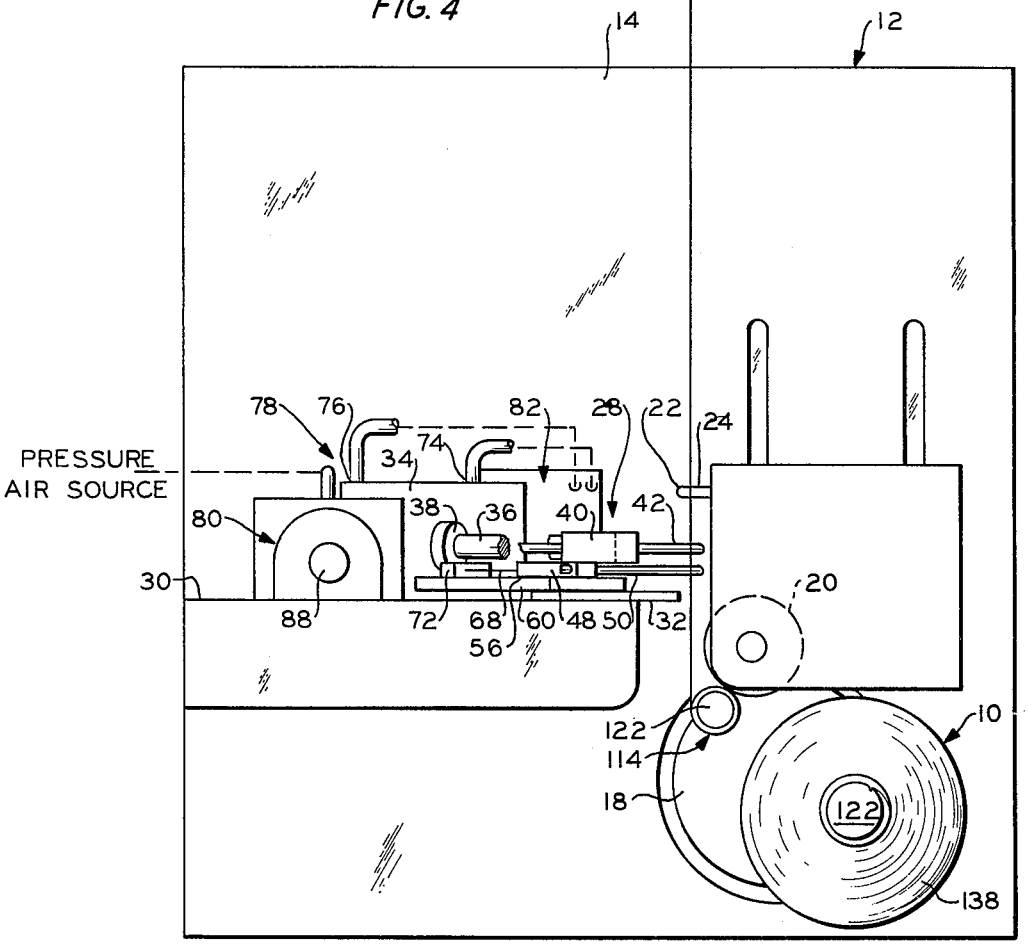
FIG. 1 is a side elevation view of a yarn winder constructed in accordance with the present invention with portions thereof broken away to more clearly illustrate construction details.

The winder 12 comprises a substantially vertically oriented supporting member 14 from which at least one horizontally oriented, rotatable chuck 16 extends. In the winder illustrated herein, a pair of chucks are journaled on a turret 18 which is, in turn, journaled on the supporting member 14 and adapted to rotate about a substantially horizontal axis. A drive roll 20 is also journaled on the supporting member 14 and is adapted to rotate about a horizontal axis parallel to the rotational axes of the chucks 16. The drive roll 20 is driven in a clockwise direction as viewed in FIG. 1 by conventional drive means (not shown) at a predetermined rotational speed. A conventional yarn traverse mechanism 22 having a pair of converging yarn-engaging fingers 24 and 26 is traversed during the winding of the main yarn package in a conventional manner as will be described more fully hereinafter.

A yarn tailing assembly 28 is mounted on a supporting base 30 which extends horizontally outwardly from the supporting member 14 to which it can be fixedly secured for cantilevered support. A yarn guide plate 32 is mounted on the supporting base 30 remote from the supporting member 14 and proximate to the drive roll 20.

A two-way pneumatic power cylinder 34 is mounted on the supporting base 30. The longitudinal axis of the cylinder 34 lies in a vertical plane which intersects the vertical plane of the rotational axis of the chuck 16 at an angle of less than 90°. A piston rod 36 extends from the rod end 38 of the pneumatic cylinder 34 and is fixedly secured at the outer end thereof to a first tailing pin head 40 in which a first tailing pin 42 is mounted. A guide pin 44 extends downwardly from the tailing pin head 40 and is slidably received in a corresponding longitudinal guide slot 46 formed in a second tailing pin head 48 in which a second tailing pin 50 is mounted. The longitudinal guide slot 46 is aligned parallel to the longitudinal axis of the piston rod 36 of the pneumatic cylinder 34 and includes outer and inner vertical walls 52 and 54 against which the guide pin 44 is adapted to abut as will be described more fully hereinafter. The lower surface 56 of the second tailing pin head 48 is slidably supported on or closely adjacent to the horizontal upper surface 58 of a guide plate 60 mounted on the supporting base 30. A pair of guide pins 62 and 64 extend downwardly from the second tailing pin head 48 and are both slidably received in a corresponding longitudinal guide slot 66 formed in the upper surface 58 of the guide plate 60. The guide slot 66 is aligned parallel to the longitudinal axes of the rod 36 of the pneumatic cylinder 34 and of the guide slot 46 of the second tailing pin head 48. The guide pins 62 and 64 provide precise guidance to the second tailing pin head 48 when the second tailing pin head is reciprocated relative to the guide plate 60 through the action of the rod 36 of the pneumatic cylinder 34, as will be described more fully hereinafter. A guide rod 68 extends rearwardly from the second tailing pin head 48 and is coaxially aligned with the longitudinal axis of the rod 36. The guide rod 68 is slidably received within a corresponding guide bore 70 which extends horizontally through a second guide plate 72 which is fixedly secured to the guide plate 60. The operation of the guide rod 68 in conjunction with the guide bore 70 serves to provide precise guidance and stability to the second tailing pin head 48 and the second tailing pin 50 in supplement to the previously described guidance provided by the guide pins 62 and 64 and the guide slot 66.

The two-way pneumatic cylinder 34 further includes a rod end port 74 and a piston end port 76. The operation of the pneumatic cylinder 34 is controlled by a pneumatic control assembly 78 mounted on the supporting base 30 and comprising a manually operated control valve subassembly 80 and a flow restrictor subassembly 82.

Figure 8:
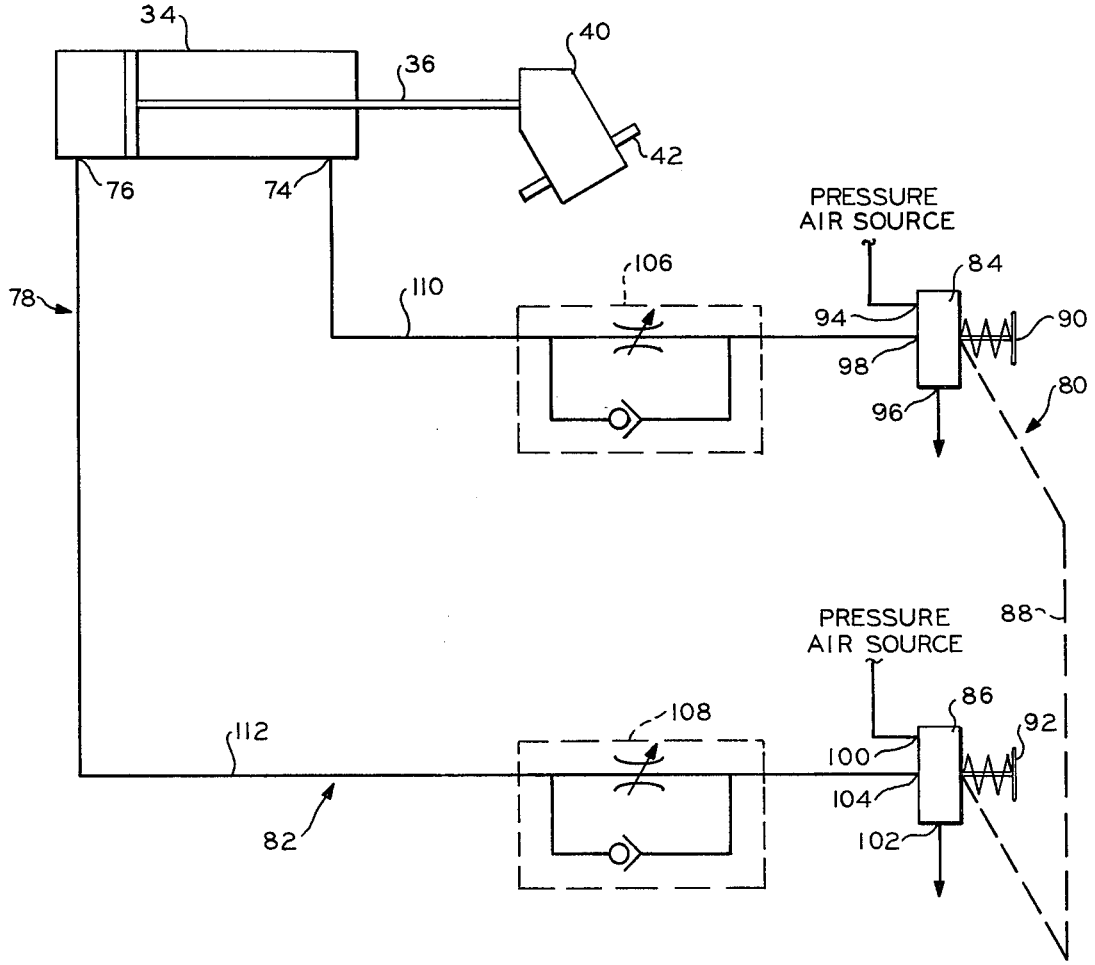
FIG. 8 is a schematic diagram illustrating the pneumatic control assembly and the pneumatic cylinder of the present invention.

The pneumatic control assembly 78 is schematically illustrated in FIG. 8. The control valve subassembly 80 comprises a normally open pneumatic control valve 84, a normally closed pneumatic control valve 86 and a ganging mechanism 88 for interengaging the operating push buttons 90 and 92 of the respective control valves 84 and 86.

The normally open control valve 84 includes a pressure port 94 connected to a suitable source of pressure air, a vent port 96 vented to the atmosphere, and an output port 98. Similarly, the normally closed control valve 86 includes a pressure port 100 also connected to a suitable source of pressure air, a vent port 102 vented to the atmosphere, and an output port 104.

The flow restrictor subassembly 82 includes first and second unidirectional flow restrictors 106 and 108. Each flow restrictor comprises a one-way check valve and a preferably adjustable orifice connected in parallel. The flow restrictor 106 is interposed in a conduit 110 which communicates between the output port 98 of the normally open control valve 84 and the rod end port 74 of the two-way pneumatic cylinder 34. The flow restrictor 108 is interposed in a conduit 112 which communicates between the output port 104 of the normally closed control valve 86 and the piston end port 76 of the pneumatic cylinder 34.

Referring again to FIGS. 1 and 2, a yarn package holder 114 is shown mounted on one rotatable chuck 16. The yarn package holder comprises a tubular bobbin 116 having a first end portion 118 and a second end portion 120. A removable start-up insert 122 is snugly received within the open first end portion 118 of the bobbin 116.

The drive roll 20 is provided with first and second circumferential starting lands 124 and 126 formed on the first and second end portions thereof and adapted to provided rolling contact with the corresponding first and second end portions 118 and 120 of the bobbin 116 during the initial yarn winding operations in the production of a yarn supply package 10. A completed yarn supply package 10 in position for doffing is shown mounted on a second rotatable chuck carried by the turret 18.

FIG. 4 illustrates the starting end portion of a completed yarn supply package 10. The yarn 128 is initially engaged in a notch 130 or the like formed on the outer periphery of the removable start-up insert 122 and is then wound in a first yarn waste bunch 132 comprising a plurality of wraps of yarn about the cylindrical outer periphery of the start-up insert. From the first yarn waste bunch, the yarn 128 is guided from left to right, as viewed in FIG. 4, from the start-up insert 122 onto the first end portion 118 of the bobbin 116 where a second yarn waste bunch 134 is wound on the bobbin 116 in the form of a plurality of yarn wraps preferably laid one on the other. From the second yarn waste bunch 134, the yarn 128 is again guided or traversed from left to right, as viewed in FIG. 4, to form a transfer tail 136 which is locked to the bobbin 116 by the second yarn waste bunch 134. The transfer tail 136 tails into the main yarn package 138 which is formed on the bobbin 116 in a conventional manner through the reciprocating action of the yarn traverse mechanism 22.

The formation of the first and second waste bunches 132 and 134, the transfer tail 136 and the main yarn package 138 is achieved in the following manner. As each new yarn supply package is prepared for winding, an empty yarn package holder 114 is installed on a rotatable chuck 16. The yarn package holder and chuck are than rotated together by means of the rotating drive roll 20 which rollingly engages the first and second end portions 118 and 120 of the bobbin 116 with the first and second starting lands 124 and 126 of the drive roll.

The running yarn 128 is directed downwardly through a yarn guide 140 toward the yarn winder 12 positioned therebeneath. Initially, the pneumatic control assembly 78 is at rest and the two-way pneumatic cylinder 34 is in its retracted position. The operator then simultaneously depresses the ganged push buttons 90 and 92 of the control valves 84 and 86 and maintains the push buttons in the depressed position causing the normally open control valve 84 to vent conduit 110 through the vent port 96 and simultaneously opening the normally closed control valve 86 so that the pneumatic cylinder 34 is pressurized through the piston end port 76 via conduit 112 and the check valve of the flow restrictor 108, and the rod end port 74 is vented via conduit 110, the orifice of the flow restrictor 106, and the control valve 84. This causes the piston rod 36 of the pneumatic cylinder 34 to be fully extended thus placing the first tailing pin 42 in the position illustrated in FIGS. 1, 2 and 3. This extension of the rod 36 also causes simultaneous parallel movement therewith of the second tailing pin head 48 through the engagement between the guide pin 44 of the first tailing pin head 40 and the outer vertical wall 52 of the longitudinal guide slot 46 in the second tailing pin head, thus placing the second tailing pin 50 in the position illustrated in FIGS. 1, 2 and 3. It will be seen that the positioning of the first and second tailing pins 42 and 50 as described places them in position to guide the running yarn 128 so as to wind the first and second yarn waste bunches 132 and 134, respectively.

While maintaining the push buttons 90 and 92 in their depressed positions, the operator engages the running yarn 128 in the notch 130 of the start-up insert 122 of the rotating yarn package holder 114 and winds the first yarn waste bunch 132 on the start-up insert. The running yarn 128 guidingly contacts the first tailing pin 42 on the extended rod 36 to maintain the running yarn in position to generate the frist yarn waste bunch 132 on the yarn package holder 114.

When a quantity of yarn is wound on the yarn package holder sufficient to generate a satisfactory first waste bunch, the operator releases the ganged push buttons 90 and 92 thereby opening the normally open control valve 84 and closing the normally closed control valve 86. By opening the control valve 84, pressure air is applied therethrough to the rod end port 74 of the pneumatic cylinder 34, while closing the normally closed control valve 86 vents the pneumatic cylinder 34 through the piston end port 76 via the conduit 112 and the orifice of the flow restrictor 108. This action allows the rod 36 of the pneumatic cylinder 34 to retract and move the tailing pin 42 quickly across the area of engagement between the first starting land 124 of the drive roll 20 and the bobbin 116 of the yarn package holder 114. During the first increment of retraction of the rod 36, the second tailing pin head 48 remains motionless in its fully extended position while the guide pin 44 moves freely along the longitudinal guide slot 46. The length of the guide slot 46 is such that the first tailing pin 42 is retracted a distance beyond the second tailing pin 50 before the guide pin 44 achieves abutting engagement with the inner vertical wall 54 of the guide slot 46. As the first tailing pin 42 is withdrawn beyond the temporarily stationary second tailing pin 50, the running yarn 128 is guidingly contacted by the second tailing pin 50 and is thereby positioned for the winding of the second yarn waste bunch 134 on the first end portion 118 of the bobbin 116.

Figure 2:
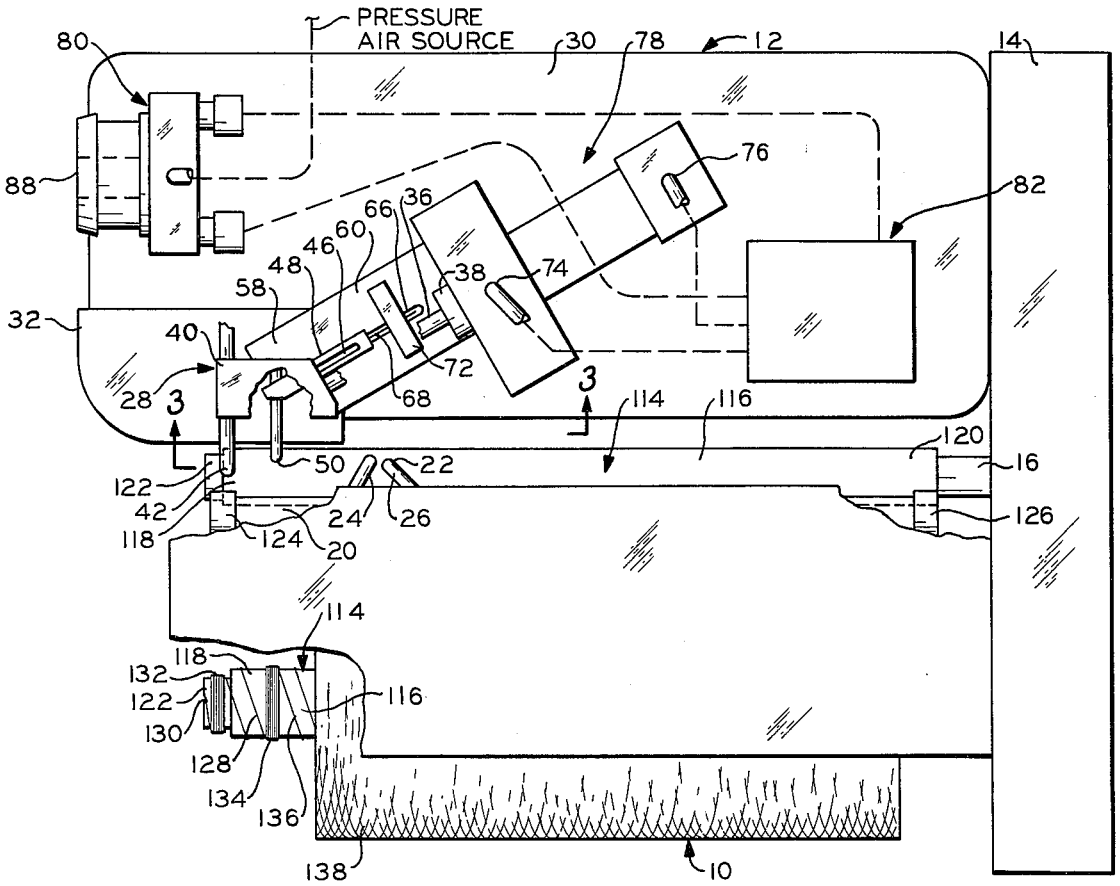
FIG. 2 is a top plan view of the yarn winder of FIG. 1 with portions thereof broken away to more clearly illustrate construction details.
Figure 3:
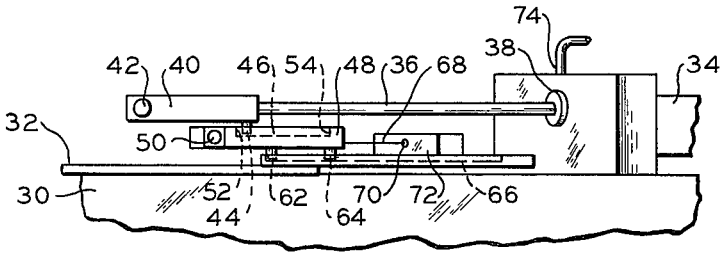
FIG. 3 is an enlarged, partial elevation view taken along line 3—3 of FIG. 2.
Figure 5:
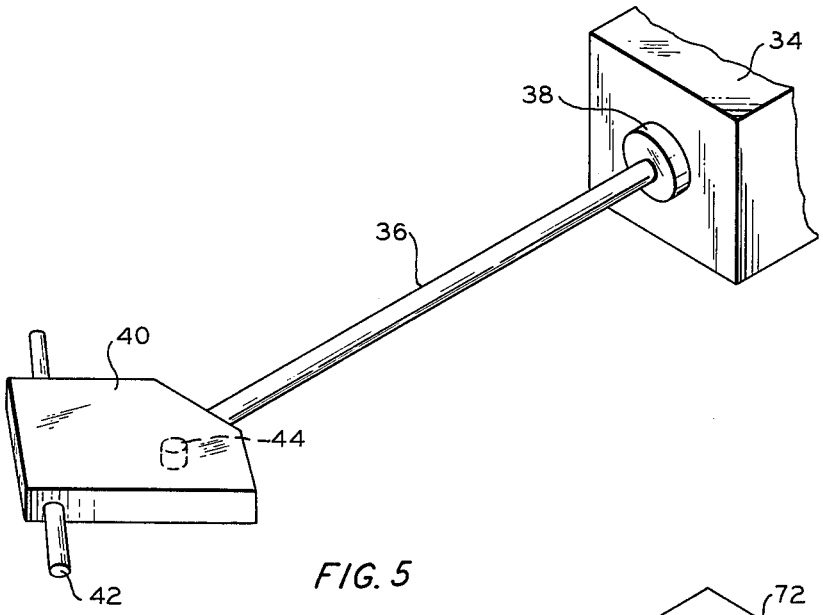
FIG. 5 is an enlarged, partial pictorial view of the piston rod of the power cylinder showing the first tailing pin head and first tailing pin mounted thereon.
Figure 6:
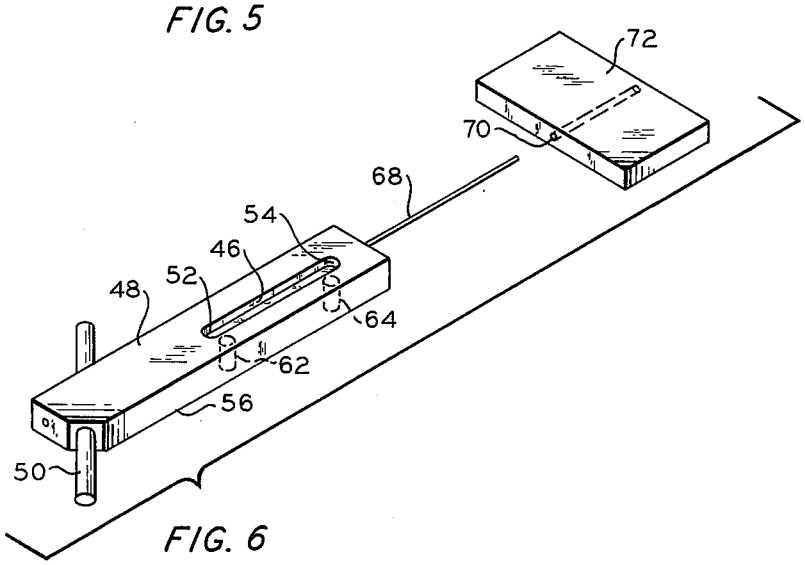
FIG. 6 is an enlarged, exploded pictorial view of the second tailing pin head and second tailing pin together with the guide plate associated therewith.
Figure 7:
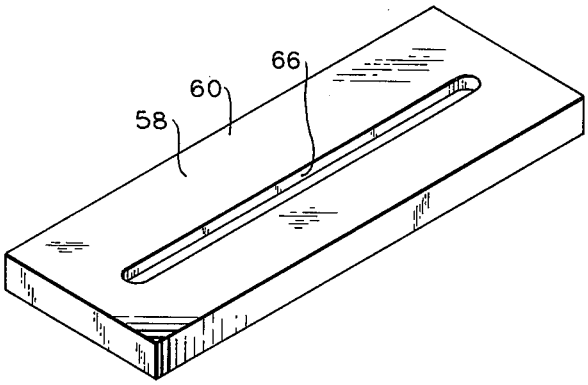
FIG. 7 is an enlarged, pictorial view of the grooved base plate.

When the guide pin 44 abuttingly engages the inner vertical wall 54 of the guide slot 46, continued retraction of the rod 36 of the pneumatic cylinder 34 causes a corresponding parallel movement of the second tailing pin head 48 and the second tailing pin 50 thereby guiding the running yarn 128 from left to right, as viewed in FIGS. 2 and 4, to generate the transfer tail 136. The final increment of retraction of the rod 36 causes complete withdrawal of the second tailing pin 50 from a position of engagement with the running yarn 128 at which time the running yarn is automatically picked up by the traverse mechanism 22 and the main yarn package 138 is then wound on the yarn package holder 114 in a conventional manner.

The rate of retraction of the piston rod 36 of the pneumatic cylinder 34 is adjusted by manipulation of the adjustable orifice of the second unidirectional flow restrictor 108. The adjustment of this adjustable orifice, coupled with the predetermined length of the longitudinal guide slot 46 of the second tailing pin head 48 provides means for determining the number of wraps of yarn which are to be applied to each second yarn waste bunch 134 on each finished yarn supply package 10. The second yarn waste bunch 134 locks in the transfer tail 136 thereby protecting the transfer tail from damage during the winding process in the event the yarn is cut by friction between the starting land 124 and the first end portion 118 of the bobbin 116 as the yarns runs from the first yarn waste bunch 132 on the start-up insert 122 onto the bobbin 116. This is an important feature of the present invention since a loose transfer tail can be destroyed during the remainder of the winding process.

Reasonable variations and modifications which will be apparent to those skilled in the art can be made in this invention without departing from the spirit and scope thereof.

What is claimed is:

1. In a continuous delivery yarn winding device of the type which includes chuck means for rotatably supporting at least one yarn package holder, drive means for rotating a yarn package holder supported by said chuck means, and yarn traversing means for traversing a running yarn during the winding thereof upon a yarn package holder to from a main yarn package, the improvement comprising:

yarn engaging means on a first end portion of a yarn package holder for engaging a running yarn whereby said yarn is wound about said yarn engaging means adjacent the first end portion of said rotating yarn package holder;

yarn tailing means for positioning said running yarn relative to said rotating yarn package holder, said yarn tailing means including:

first tailing pin means for contacting said running yarn and positioning said yarn along said rotating yarn package holder in a first position corresponding to a first position of said first tailing pin means and thereafter guiding said running yarn along said rotating yarn package holder from the first position of said yarn on said yarn package holder; and second tailing pin means for contacting said running yarn and positioning said yarn along said rotating yarn package holder in a second position corresponding to a first position of said second tailing pin means and thereafter guiding said running yarn along said rotating yarn package holder from the second position on said yarn package holder; and control means operatively connected to said yarn tailing means for positioning said first tailing pin means in the first position thereof and for positioning said second tailing pin means in the first position thereof in response to a first signal applied to said control means whereby said running yarn is aligned with the first position on said yarn package holder to form a first waste bunch of yarn thereon, for automatically moving said first tailing pin means out of contact with said running yarn in response to a second signal applied to said yarn tailing means whereby said running yarn is positioned in contact with said second tailing pin means and is aligned with the second position on said yarn package holder for a predetermined time period whereby said running yarn is positioned to form a second waste bunch of yarn on said rotating yarn package holder a distance from said first waste bunch of yarn, and for automatically moving said second tailing pin means from the first position thereof to a second position thereof after said predetermined time period whereby said running yarn forms a transfer tail on said rotating yarn package holder during said movement of said second tailing pin means to the second position thereof, whereby the running yarn is so positioned as to be engaged by said traversing means for traversing the running yarn along said yarn package holder to form main yarn package and said second tailing pin means is disengaged from said running yarn.

2. The continuous delivery yarn winding device as defined in claim 1 wherein said yarn tailing means is characterized further to include:

power cylinder means having a piston rod extending therefrom and positioned adjacent said chuck means for extending and retracting said piston rod in response to said control means;

means for mounting said power cylinder means and said chuck means in relative fixed positional relation;

means for securing said first tailing pin means to said piston rod whereby said first tailing pin means positions said running yarn along a rotating yarn package holder in response to extension and, alternately, retraction of said power cylinder means;

means for mounting said second tailing pin means proximate to said first tailing pin means for movement of said second tailing pin means along a line parallel to the piston rod of said power cylinder; and means operatively mutually engaging said first and second tailing pin means whereby full extension of said power cylinder means in response to the first signal applied to said control means places both said first and second tailing means in their respective first positions, whereby a first increment of retraction of said power cylinder means in response to the second signal applied to said control means moves said first tailing pin means from its first position to a position out of contact with said running yarn without moving said second tailing pin means from the first position thereof, and whereby a second increment of retraction of said power cylinder means moves said second tailing pin means from its first position to its second position.

3. The continuous delivery yarn winding device as defined in claim 2 wherein the axis of rotation of the rotating yarn package holder and the longitudinal axis of the piston rod or said power cylinder rod means lie in mutually intersecting vertical planes, said planes intersecting at an included angle of less than 90°.

4. The continuous delivery yarn winding device as defined in claim 2 wherein:

said power cylinder is a two-way pneumatic cylinder having a rod end port and a piston end port; and said control means is a pneumatic control system comprising:

normally open control valve means having a pressure port, an output port and a vent port for normally communicating the pressure port and output port thereof in a first position and, alternately, communicating the output port and vent port thereof in a second position in response to an external signal applied thereto;

normally closed control valve means having a pressure port an output port and a vent port for normally communicating the output port and the vent port thereof in a first position and, alternately, communicating the pressure port and output port thereof in a second position in response to an external signal applied thereto;

first conduit means for providing communication between the output port of said normally open control valve means and the rod end port of said pneumatic cylinder;

first unidirectional flow restrictor means interposed in said first conduit means for providing a restricted flow path therethrough from the rod end port of said pneumatic cylinder to the output port of said normally open control valve means and, alternately, for providing a substantially unrestricted flow path therethrough from the output port of said normally open control valve means to the rod end port of said pneumatic cylinder;

second conduit means for providing communication between the output port of said normally closed control valve means and the piston end port of said pneumatic cylinder;

second unidirectional flow restrictor means interposed in said second conduit means for providing a restricted flow path therethrough from the piston end port of said pneumatic cylinder to the output port of said normally closed control valve means and, alternately, for providing a substantially unrestricted flow path therethrough from the output port of said normally closed control valve means to the piston end port of said pneumatic cylinder;

third conduit means for providing communication between the pressure port of said normally open control valve means and a pressure air source; and third conduit means for providing communication between the pressure port of said normally closed control valve means and a pressure air source.

5. The continuous delivery yarn winding device as defined in claim 4 characterized further to include:

means operatively linking said normally open control valve means and said normally closed control valve means for simultaneously moving said control valves from their first positions to their second positions in response to a single external signal applied thereto.

6. An apparatus for making two yarn waste bunches on a yarn package holder having yarn engaging means on one end portion thereof and rotated by a continuous delivery yarn winding device having chuck means for rotatably supporting at least one yarn package holder for rotation about its axis of rotation, drive means for rotating a yarn package holder supported by the chuck means, and yarn traversing means for traversing a running yarn along a rotating yarn package holder during the winding thereof on the yarn package holder to form a main yarn package, said apparatus comprising:

a supporting base;

yarn tailing means supported on said supporting base for positioning a running yarn engaged by the yarn engaging means of a rotating yarn package holder relative to said rotating yarn package holder during the winding of said running yarn on said rotating yarn package holder, said yarn tailing means including:

first tailing pin means for contacting said running yarn to guide said yarn as it winds on said rotating yarn package holder into a first position thereon when said first tailing pin means is in its first position to form a first yarn waste bunch on said yarn package holder and subsequently guiding said running yarn along said rotating yarn package holder from the first yarn waste bunch; and second tailing pin means for contacting said running yarn subsequent to the formation of said first yarn waste bunch to guide said yarn as it winds on said rotating yarn package holder into a second position thereon when said second tailing pin means is in its first position to form a second yarn waste bunch on said yarn package holder and subsequently to guide said running yarn as it winds on said rotating yarn package holder from the second yarn waste bunch to form a transfer tail as said second tailing pin means moves to its second position; and control means operatively connected to said yarn tailing means for positioning said first and second tailing pin means in their respective first positions in response to a first signal applied to said control means whereby said running yarn is guided by said first tailing pin means to form a first yarn waste bunch on said yarn package holder, for moving said first tailing pin means to guide said running yarn into position in contact with said second tailing pin means and out of contact with said first tailing pin means in response to a second signal applied to said yarn tailing means whereby said running yarn is guided by said second tailing pin means to form a second yarn waste bunch on said yarn package holder a distance from said first yarn waste bunch, and for automatically moving said second tailing pin means from its first position to its second position upon the formation of the second yarn waste bunch whereby said running yarn is guided by said second tailing pin means and forms a transfer tail wound on said rotating yarn package holder and is subsequently positioned so as to be engaged by said traversing means for traversing the running yarn along said yarn package holder to form a main yarn package and said second tailing pin means is withdrawn from guiding contact with said running yarn.

7. The apparatus as defined in claim 6 wherein said yarn tailing means is characterized further to include:

power cylinder means supported on said supporting base having a piston rod extending therefrom and positioned proximate to said rotating yarn package holder for extending and retracting said piston rod in response to said control means;

means for securing said first tailing pin means to said piston rod whereby said first tailing pin means guides said running yarn in response to extension and retraction of said piston rod means;

means for supporting said second tailing pin means on said supporting base proximate to said first tailing pin means for movement of said second tailing pin means along a line substantially parallel to the longitudinal axis of the piston rod of said power cylinder;

means operatively engaging said first and second tailing pin means whereby full extension of said power cylinder means in response to the first signal applied to said control means positions said first and second tailing pin means in their respective first positions, whereby partial retraction of said power cylinder means in response to the second signal applied to said control means moves said first tailing pin means from its first position to a position out of contact with said running yarn while said second tailing pin means remains in the first position thereof, and whereby subsequent full retraction of said power cylinder means moves said second tailing pin means from its first position to its position out of contact with said running yarn.

8. The apparatus as defined in claim 6 wherein said yarn tailing means is characterized further to include:

power cylinder means supported on said supporting base and having a piston rod extending therefrom and positioned proximate to said rotating yarn package holder for extending and retracting said piston rod in response to said control means;

tailing pin support means for securing said first tailing pin means to said piston rod whereby said first tailing pin means guides said running yarn in response to extension and retraction of said piston rod;

first guide means carried by said supporting base for defining a path along a line parallel to the longitudinal axis of said piston rod;

a tailing pin support head movably disposed relative to said supporting base and having first guide follower means mounted thereon for cooperating with said first guide means for guiding the movement of said tailing pin support head along the path defined by said first guide means;

second tailing pin support means for securing said second tailing pin means to said tailing pin support head whereby said second tailing pin means guides said running yarn in response to movement of said tailing pin support head;

second guide means carried by said tailing pin support head for defining a second path in a line parallel to the longitudinal axis of said piston rod;

second guide follower means mounted on said piston rod for cooperating with said second guide means for guiding the movement of said piston rod relative to said tailing pin support head along the second path defined by said second guide means; and said second guide means and said second guide follower means further mutually cooperating for defining a predetermined limited amount of free movement of said piston rod relative to said tailing pin support head and for drivingly mutually engaging said piston rod and said tailing pin support head at the opposite limits of said free relative movement therebetween, whereby at one limit of said free relative movement further extension of said piston rod causes a corresponding movement of said tailing pin support head in the same direction and, alternately, at the opposite limit of said relative free movement further retraction of said piston rod causes a corresponding movement of said tailing pin support head in the same direction.

9. The apparatus as defined in claim 8 wherein:

said power cylinder means is a two-way pneumatic cylinder having a rod end port and a piston end port; and said control means is a pneumatic control system comprising:

normally open control valve means having a pressure port, an output port and a vent port for normally communicating the pressure port and output port thereof in a first position and, alternately, communicating the output port and vent port thereof in a second position in repsonse to an external signal applied thereto;

normally closed control valve means having a pressure port, an output port and a vent port for normally communicating the output port and the vent port thereof in a first position and, alternately, communicating the pressure port and output port thereof in a second position in response to an external signal applied thereto;

first conduit means for providing communication between the output port of said normally open control valve means and the rod end port of said pneumatic cylinder;

first unidirectional flow restrictor means interposed in said first conduit means for providing a restricted flow path therethrough from the rod end port of said pneumatic cylinder to the output port of said normally open control valve means and, alternately, for providing a substantially unrestricted flow path therethrough from the output port of said normally open control valve means to the rod end port of said pneumatic cylinder;

second conduit means for providing communication between the output port of said normally closed valve means and the piston end port of said pneumatic cylinder;

second unidirectional flow restrictor means interposed in said second conduit means for providing a restricted flow path therethrough from the piston end port of said pneumatic cylinder to the output port of said normally closed control valve means and, alternately, for providing a substantially unrestricted flow path therethrough from the output port of said normally closed control valve means to the piston end port of said pneumatic cylinder;

third conduit means for providing communication between the pressure port of said normally open control valve means and a pressure air source;

fourth conduit means for providing communication between the pressure port of said normally closed control valve means and a pressure air source.

10. The apparatus as defined in claim 9 characterized further to include:

means operatively linking said normally open control valve means and said normally closed control valve means for simultaneously moving said control valves from their first positions to their second positions in response to a single external signal applied thereto.

* * * * *

UNITED STATES PATENT AND TRADEMARK OFFICE

CERTIFICATE OF CORRECTION

PATENT NO. : 4,103,834

DATED : August 1, 1978

INVENTOR(S) : Jack A. Banning

It is certified that error appears in the above-identified patent and that said Letters Patent are hereby corrected as shown below:

Column 7, claim 3, line 58, after "rod" and before "said", the word "or" should be --- of ---.

Signed and Sealed this

*Eighteenth* Day of *September 1979*

[SEAL]

*Attest:*

*Attesting Officer*

LUTRELLE F. PARKER

*Acting Commissioner of Patents and Trademarks*